United States Patent [19]

Forward

[11] 4,068,340

[45] Jan. 17, 1978

[54] STEAM AND VACUUM CLEANING APPARATUS

[75] Inventor: Raymond John Forward, Stevenage, England

[73] Assignee: Steam Vacuum Extraction Limited, England

[21] Appl. No.: 696,507

[22] Filed: June 16, 1976

[30] Foreign Application Priority Data

June 20, 1975 United Kingdom ..... 26394/75

[51] Int. Cl.[2] ..... A47L 7/00

[52] U.S. Cl. ..... 15/321; 15/339; 15/413

[58] Field of Search ..... 15/320, 321, 339, 413, 15/327 F

[56] References Cited

U.S. PATENT DOCUMENTS

| | | | |
|---|---|---|---|
| 2,198,322 | 4/1940 | Von Schrader | 15/321 X |
| 3,720,977 | 3/1973 | Brycki | 15/321 |
| 3,818,537 | 6/1974 | Evans | 15/321 |
| 3,848,290 | 11/1974 | Bates | 15/413 X |
| 3,854,163 | 12/1974 | Evans | 15/321 |
| 3,942,217 | 3/1976 | Bates | 15/321 |

FOREIGN PATENT DOCUMENTS

| | | | |
|---|---|---|---|
| 408,312 | 9/1966 | Switzerland | 15/321 |
| 1,288,763 | 9/1972 | United Kingdom | 15/321 |

*Primary Examiner*—Christopher K. Moore
*Attorney, Agent, or Firm*—Andrew R. Basile

[57] ABSTRACT

A lightweight mobile and efficient apparatus for cleaning fabrics by the simultaneous application thereto of steam and vacuum comprises a trolley having a lower deck which supports a water tank and a vacuum tank, and a detachable upper deck on which at least one motor, pump and ancillary components thereof are mounted.

1 Claim, 3 Drawing Figures

STEAM AND VACUUM CLEANING APPARATUS

This invention relates to steam and vacuum cleaning apparatus of the general kind disclosed in U.S. Pat. No. 3,226,146, our British patent specification No. 1,286,985 and our co-pending British Patent Application No. 17323/75. Such apparatus comprises a steam and hot water supply unit and a vacuum generating unit, each having a tank, and means for supplying steam and hot water and vacuum from these units to a hand tool. In operation, hot water and steam — a term which in this industry mainly connotes water vapour — with or without a solvent fluid, is applied to fabric material which is to be cleaned and is continuously withdrawn with entrained dirt under the effect of the vacuum.

The main object of the invention is to provide a design which permits production of a particularly light, mobile and efficient form of apparatus of the kind referred to.

In accordance with the invention, steam and vacuum cleaning apparatus of the kind referred to comprises a trolley having a lower deck which supports a water tank and a vacuum tank, and an upper detachable deck on which at least one motor, pump and ancillary components thereof are mounted.

A particular and at present preferred embodiment of the invention is illustrated in the accompanying drawings, in which:

FIG. 1 is a sectional elevation, in the direction of arrow A in FIG. 2 of a mobile steam and vacuum cleaning apparatus;

FIG. 2 is a plan view of that apparatus; and

FIG. 3 is a general perspective view thereof.

Referring now to the drawings, the apparatus comprises a trolley with castors 23 and on the base platform of which there is carried a vacuum tank 24 within the confines of a water tank 9, both of these tanks having walls made of transparent material for observation of their contents. This tank assembly has lifting handles 22. The tank assembly is surmounted by a lightweight main, or lower deck 27 which carries in separate compartments the dynamic and ancillary components of the apparatus and which is detachably secured to the tank assembly by four toggle fasteners 26. Attached to the deck 27 is a carrying handle 2, the legs of which serve to retain in position a cover 1 made of tough lightweight material.

Mounted on the deck 27 above the tank 9 is a pressure pump 4 with an inlet pipe 5 coupled to a check valve 6 normally immersed in the water and cleaning fluid in the tank 9. Also shown in the vicinity of the pressure pump 4 is a mains electrical supply plug 3, a pressure pump motor illuminated rocker switch 12, a water pump fuse holder 14 and a water pump pressure outlet valve 28.

Alongside the aforementioned components but in a separate compartment above the tank 24 there is mounted an auxiliary deck 17 which supports a vacuum pump motor 16. The vacuum pump itself is located between the auxiliary deck 17 and the main deck 27 and has a casing with exhaust louvres 30. Beside the casing there is a vacuum hose connector 29 coupled to a dirty water anti-turbulence filter 19 above which there is a vacuum motor inlet filter assembly 18. To one side of the vacuum pump motor 16 is its fuseholder 13 and illuminated rocker switch 11.

The cover 1 has an opening which reveals the supply plug 3, and other openings 7 and 25 which respectively constitute cooling air inlets to the vacuum pump motor and the pressure pump motor. A louvred opening 10 is a cooling air outlet from the pressure pump motor.

To prepare the apparatus for operation, hot water, mixed if desired with a water softener and/or a cleaning fluid, is poured into the tank 9.

A pressure hose connected at its other end to a hand tool is inserted into the pressure outlet valve 28 and a vacuum hose connected at its other end also to the hand tool is inserted into the vacuum hose connector 29. The mains cable socket is inserted into the main input plug 3. The apparatus is now ready for operation.

Pressing the switch 12 causes the pressure pump motor 4, to start, with the result that providing the pump is primed hot water will be delivered to the hand tool.

Pressing the switch 11 causes the vacuum pump motor to start with the result that dirty liquid is drawn into and through the hand tool and thence into the vacuum tank 24 and strained through the filter 19. The air then passes through the filter 18 and out through the vacuum pump exhaust louvres 30 into an exhaust chamber before passing out through a vacuum exhaust and hose connection 15.

Apparatus as above described has unique features in that it can be constructed so as to be very light and portable and has the advantage of having only two major sub-units. Since the tanks have transparent walls the operator can observe how the apparatus is operating and this obviates the necessity for having level controls such as are commonly fitted on larger and more expensive apparatus.

Because each motor unit is in a separate compartment there is no interaction between their respective cooling air flow systems. Also because the vacuum exhaust expands into a separate chamber there is no chance of the warm moist air of the exhaust becoming mixed with the cooling air.

I claim:

1. A hot water and vacuum cleaning apparatus comprising:

a wheeled base platform;

a transparent water tank and a transparent vacuum tank mounted on the upper portion of said wheeled base platform, said vaccum tank having a common wall with said water tank;

a main deck releasably attached to the upper portions of said tanks to enclose said tanks, said deck having separate compartments;

attaching means carried by said tanks for releasably engaging said main deck to secure said main deck to said tanks;

a pressure pump mounted on the upper surface of said main deck in one of said separate compartments above said water tank, said pump having an inlet pipe extending through said main deck and into said water tank, said pump having an outlet;

an auxiliary deck mounted in another compartment of said main deck above said vacuum tank;

a vacuum pump motor supported on said auxiliary deck;

a vacuum pump supported between said main deck and said auxiliary deck and drivingly connected to said vacuum pump motor, said vacuum pump having an inlet extending through said main deck and into said vacuum tank;

a cover retained on said main deck to enclose said compartments;

a U-shaped carrying handle having a base and a pair of downwardly extending legs which retain said cover on said main deck to permit a user to grasp said base and remove said main deck from said tanks when said attaching means are released;

first coupling means accessible through said cover for connecting a hose to said pressure pump; and second coupling means accessible through said cover for connecting a second hose to said vacuum tank.

* * * * *

UNITED STATES PATENT AND TRADEMARK OFFICE

CERTIFICATE OF CORRECTION

PATENT NO. : 4,068,340

DATED : 1/17/78

INVENTOR(S) : Raymond J. Forward

It is certified that error appears in the above-identified patent and that said Letters Patent are hereby corrected as shown below:

Column 1, preceding line 4, insert

--BACKROUND OF THE INVENTION --;

Column 1, preceding line 27, insert

--BRIEF DESCRIPTION OF THE DRAWINGS-- :

Column 1, preceding line 35, insert

Figure 1:
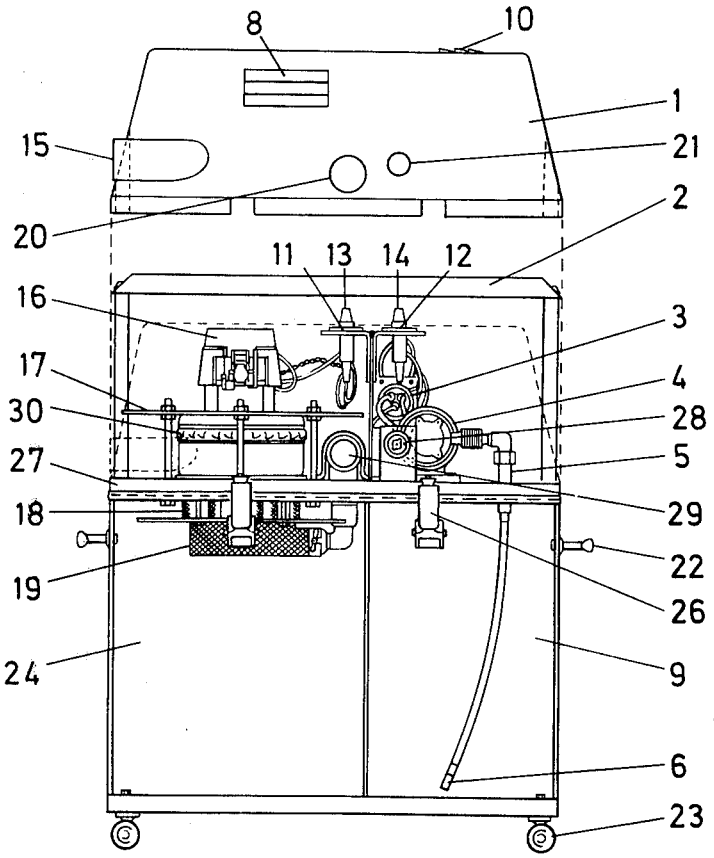
Figure 2:
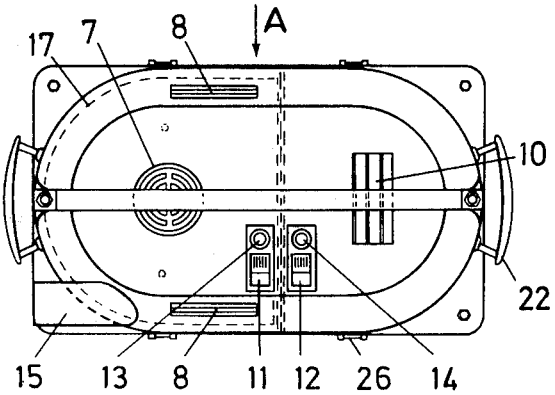
Figure 3:
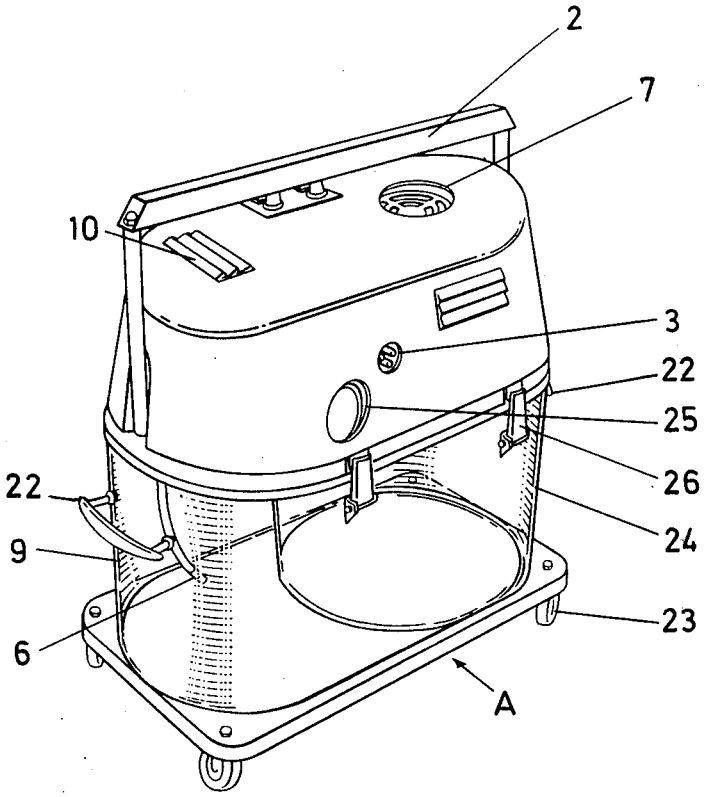

--DESCRIPTION OF THE PREFERRED EMBODIMENT--;

Column 2, line 3, following "motor" insert --16--;

Column 2, line 4, following "motor" insert --4--;

Column 2, line 5, following "motor" insert --4--;

Column 2, line 13, preceding "plug" delete "main input" and insert --supply--;

Column 2, line 16, following "that" insert a comma (,) :

Column 2, line 17, following "primed" insert a comma (,) :

Column 2, line 20, following "motor" insert --16--;

UNITED STATES PATENT AND TRADEMARK OFFICE

CERTIFICATE OF CORRECTION

PATENT NO. : 4,068,340

DATED : 1/17/78

INVENTOR(S) : Raymond John Forward

It is certified that error appears in the above-identified patent and that said Letters Patent are hereby corrected as shown below:

Column 2, line 30, following "walls" insert a comma (,) ;

Column 2, line 47, preceding "tank" delete "vaccum" and insert --vacuum--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*